US005210819A

United States Patent [19]

Huang

[11] Patent Number: 5,210,819

[45] Date of Patent: May 11, 1993

[54] HEATING DEVICE FOR A HEAT TRANSFER MEDIUM

[76] Inventor: Chih-Lien Huang, No. 308, Chung-Cheng S. Rd., Yung-Kang Hsiang, Tainan Hsien, Taiwan

[21] Appl. No.: 872,631

[22] Filed: Apr. 22, 1992

[51] Int. Cl.[5] ..... F24H 1/20

[52] U.S. Cl. ..... 392/450

[58] Field of Search ..... 392/443, 450, 451, 449; 122/448.3, 13.2, 4 A; 126/361, 362

[56] References Cited

U.S. PATENT DOCUMENTS

| | | | |
|---|---|---|---|
| 736,702 | 8/1903 | Davis | 122/448.3 |
| 1,399,515 | 12/1921 | Phelps | 392/450 |
| 1,471,821 | 10/1923 | Besta | 122/448.3 |
| 1,555,338 | 9/1925 | Vaughan | 392/449 |
| 1,931,145 | 10/1933 | Hall | 392/451 |
| 4,171,593 | 10/1979 | Bigglestone | 47/79 |

*Primary Examiner*—Teresa J. Walberg
*Attorney, Agent, or Firm*—Ladas & Parry

[57] ABSTRACT

A heating device for a circulating heat transfer medium includes first and second heating stages. Each of the first and second heating stages has a first chamber and a second chamber disposed above and communicated with the corresponding first chamber. The first chamber has an inlet, an outlet and at least one electric heating unit provided therein. A conduit has two ends respectively connected to the outlet of the first chamber of the first heating stage and to the inlet of the first chamber of the second heating stage. Heat transfer medium which flows through the heating device undergoes two heating steps in the first and second heating stages. Gradual heating of the heat transfer medium is thus employed, thereby slowing down the degradation of the heat transfer medium.

4 Claims, 3 Drawing Sheets

HEATING DEVICE FOR A HEAT TRANSFER MEDIUM

BACKGROUND OF THE INVENTION

1. Field of the Invention

The invention relates to a heating device, more particularly to a heating device for a heat transfer medium, which heating device does not cause pollution and can prolong the useful life of the heat transfer medium.

2. Description of the Related Art

A roller assembly is normally employed to advance a plastic film product which is obtained from a conventional plastic film manufacturing process. The plastic film product is very thin, is at a relatively high temperature immediately after manufacture, and therefore requires gradual cooling so as to prevent adverse effects to the same. If the roller assembly was not heated to a desired temperature before the plastic film product was advanced, immediate contact between the plastic film product and the roller assembly would cause a rapid decrease in the temperature of the former, thereby resulting in unfavorable effects to the plastic film product.

In order to maintain the roller assembly at the desired temperature when advancing the plastic film product, the roller assembly is usually provided with a pipe member which extends therethrough. A circulating heat transfer medium (such as heat transfer oil) is heated by a boiler and flows through the pipe member. Conventional boilers are usually heated by coal or oil and are used to apply heat to the pipe member or to a reservoir containing the heat transfer medium. The heat transfer medium, which was heated by the boiler, flows through the pipe member and is returned to the boiler so as to be heated again.

The above described heating process has several drawbacks. The conventional coal or oil-fired boilers emit smoke and can cause air pollution. Furthermore, rapid heating and cooling of the heat transfer medium which flows through the pipe member can easily cause faster degradation of the heat transfer medium. That is, the heat transfer medium becomes viscous and resinous-like, making it difficult for the heat transfer medium to flow through the pipe member. Under such conditions, replacement of the heat transfer medium is therefore required. Frequent replacement of the heat transfer medium increases the production costs incurred and can cause frequent interruptions in the production process.

SUMMARY OF THE INVENTION

Therefore, the objective of the present invention is to provide a heating device for a heat transfer medium, which heating device does not cause pollution and can prolong the useful life of the heat transfer medium.

Accordingly, the preferred embodiment of a heating device of the present invention is used to heat a circulating heat transfer medium and comprises:

first and second heating stages, each of the first and second heating stages having a first chamber and a second chamber disposed above and communicated with the corresponding first chamber, said first chamber having an inlet, an outlet and at least one electric heating unit provided therein; and a conduit having two ends respectively connected to the outlet of the first chamber of the first heating stage and to the inlet of the first chamber of the second heating stage.

The circulating heat transfer medium which flows through the preferred embodiment undergoes two heating steps in the first and second heating stages. Gradual heating of the heat transfer medium is therefore employed so as to prolong the useful life of the same.

BRIEF DESCRIPTION OF THE DRAWINGS

Other features and advantages of the present invention will become apparent in the following detailed description of the preferred embodiment, with reference to the accompanying drawings, of which:

FIG. 1 is a II—II section of the heating device shown in FIG. 1; and

DETAILED DESCRIPTION OF THE PREFERRED EMBODIMENT

Figure 1:
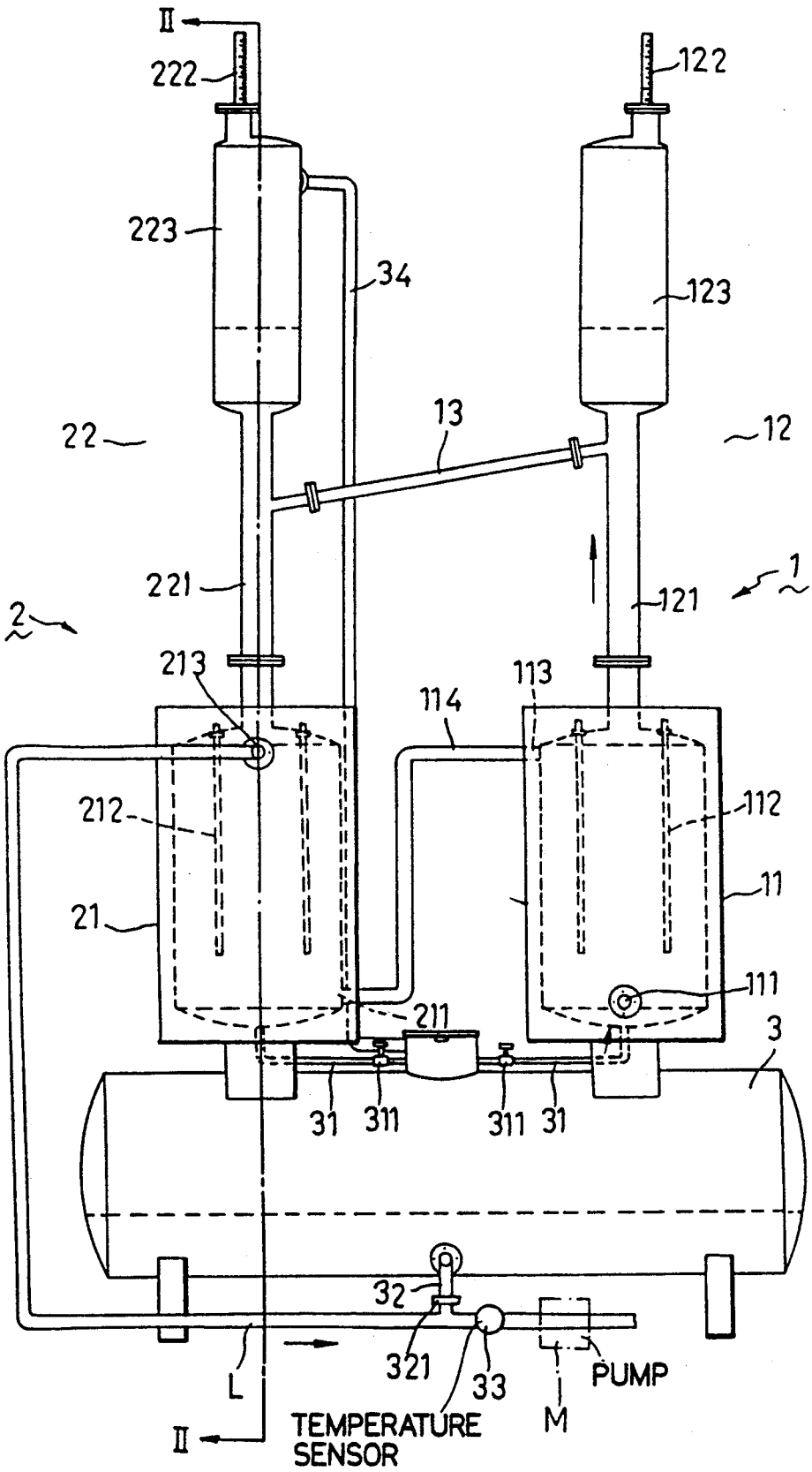
FIG. 1 is a front view of the preferred embodiment of a heating device according to the present invention.
Figure 2:
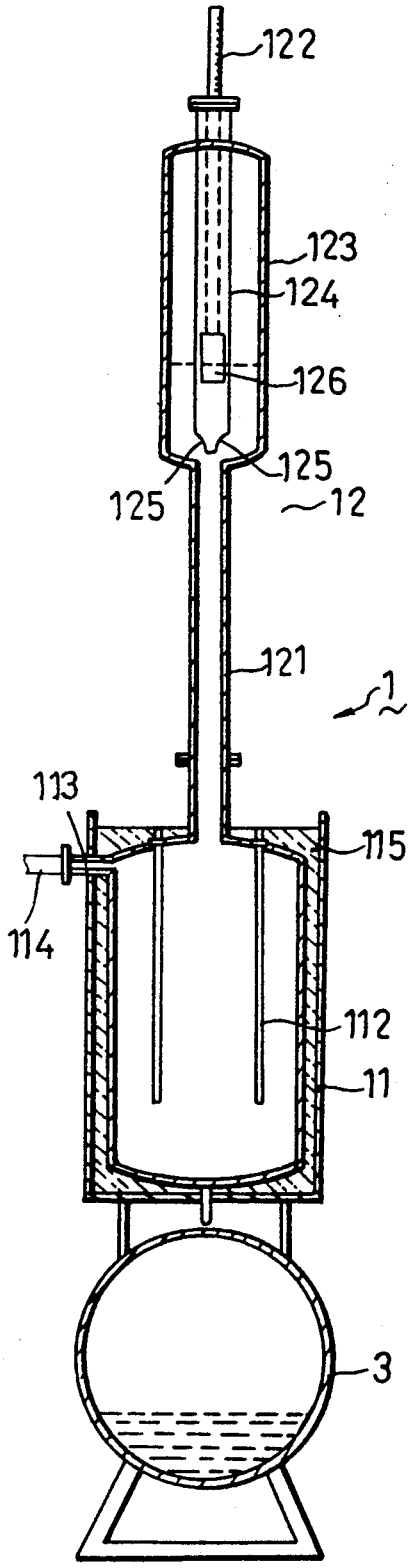
Figure 3:
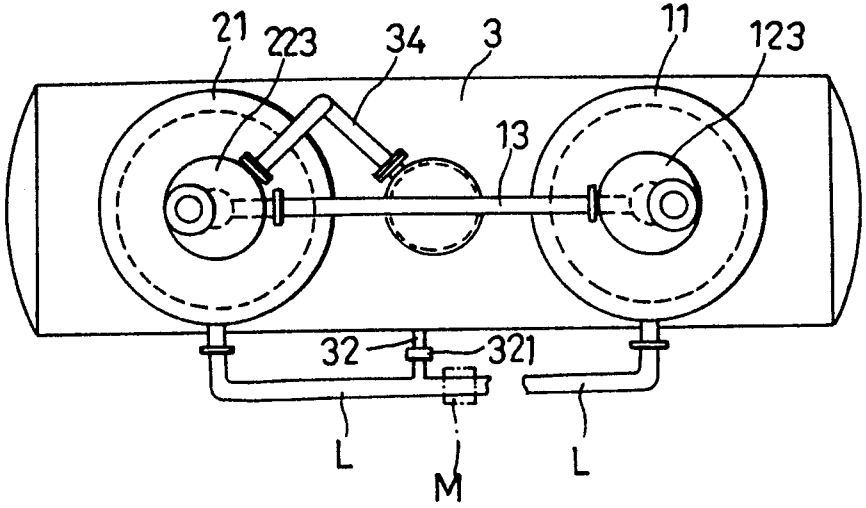
FIG. 3 is a top view of the heating device shown in FIG. 1.

Referring to FIGS. 1, 2 and 3, the preferred embodiment of a heating device according to the present invention is shown to comprise a first heating stage (1), a second heating stage (2) and a flow control and temperature adjustment chamber (3).

The first heating stage (1) includes a first chamber (11) and a second chamber (12) disposed above the first chamber (11). The second chamber (12) includes an upright pipe (121) which communicates the first and second chambers (11, 12). The second chamber (12) further includes a tank (123) and a tubular member (124) which extends vertically into the tank (123). The tubular member (124) has a bottom end which is provided with a pair of openings (125) so as to permit heat transfer medium inside the tank (123) to flow therein. A level indicating rod (122) extends vertically into the tubular member (124). A float (126) is secured to the lowermost end of the rod (122) so as to permit the uppermost end of the latter to extend out of the tubular member (124) and indicate the level of heat transfer medium inside the tank (123).

The first chamber (11) is provided with an inlet (111) adjacent to a lower end of the same for receiving a circulating heat transfer medium. The outer surface of the first chamber (11) is covered with a heat insulating layer (115). A plurality of electric heating units (112) extend vertically into the first chamber (11) so as to heat the heat transfer medium which flows therein. The first chamber (11) is further provided with an outlet (113) adjacent to an upper end of the same. One end of a conduit (114) is connected to the outlet (113).

The second heating stage (2) is substantially similar in construction to the first heating stage (1) The second heating stage (2) includes a first chamber (21) and a second chamber (22) disposed above the first chamber (21). The second chamber (22) includes an upright pipe (221) which communicates the first and second chambers (21, 22). The second chamber (22) further includes a tank (223) and a level indicating rod (222) which extends vertically into the tank (223) [The arrangement of the components inside the tank (223) is similar to that of the tank (123) inside the first heating stage (1) and will not be detailed further].

The first chamber (21) is provided with an inlet (211) adjacent to a lower end of the same and connected to the other end of the conduit (114) The first chamber (21) thus receives preheated heat transfer medium from the first chamber (11) of the first heating stage (1). A plurality of electric heating units (212) extend vertically into the first chamber (21) so as to provide additional heating to the heat transfer medium. The first chamber (21) is further provided with an outlet (213) adjacent to an upper end of the same. A pipe member (L) is connected to the outlet (213). The heat transfer medium, which flows through the pipe member (L), is used to heat another body (such as the roller assembly used in conventional plastic film manufacturing processes) and is returned to the preferred embodiment at the inlet (111) of the first chamber (11). A second conduit (13) communicates the upright pipes (121, 221) of the first and second heating stages (1, 2) so as to help achieve equilibrium of the heat transfer medium therein.

The flow control and temperature adjustment chamber (3) is disposed beneath the first chambers (11, 21) of the first and second heating stages (1, 2). Pipes (31) are provided so as to communicate the first chambers (11, 21) and the adjustment chamber (3). A control valve (311) is provided on each of the pipes (31) so as to control the flow of heat transfer medium from the first chambers (11, 21) into the adjustment chamber (3). The adjustment chamber (3) has a pipe (32) which is disposed adjacent to a lower end of the same. The pipe (32) is communicated with the pipe member (L) and is provided with a control valve (321) for controlling the flow of heat transfer medium therethrough. A temperature sensor (33) is provided on the pipe member (L) at a location upstream of the junction of the pipe member (L) and the pipe (32) so as to detect the temperature of the heat transfer medium flowing through the pipe member (L). When the temperature of heat transfer medium from the first chamber (21) of the second heating stage (2) is excessively high, the control valve (321) may be operated so as to release cooler heat transfer medium from the adjustment chamber (3) into the pipe member (L), thereby gradually lowering the temperature of the heat transfer medium flowing through the pipe member (L). The heat transfer medium in the pipe member (L) passes through a pump (M) before being sent to the intended environment.

Note that because of the additional heat transfer medium from the adjustment chamber (3), the amount of heat transfer medium in the first and second heating stages (1, 2) increases, thereby increasing the level of heat transfer medium therein. Since the level of heat transfer medium which can be confined by the first and second heating stages (1, 2) is limited and cannot be increased indefinitely, some means must be provided so as to avoid overflowing of the first and second heating stages (1, 2). In the preferred embodiment, an overflow tube (34) has a first end connected to the tank (223) adjacent to the top end of the same and a second end connected to the adjustment chamber (3). Heat transfer medium in the tank (223) which reaches the first end of the overflow tube (34) is sent to the adjustment chamber (3) so as to prevent the first and second heating stages (1, 2) from overflowing and therefore maintain the volume of heat transfer medium in the first and second heating stages (1, 2) and in the adjustment chamber (3) in an equilibrium state.

From the foregoing, it can be shown that the heat transfer medium which passes through the preferred embodiment undergoes two heating steps: the first step being in the first chamber (11) of the first heating stage (1) and the second step being in the first chamber (21) of the second heating stage (2). The heat generated by the heating elements (112) in the first chamber (11) is weaker than that generated by the heating elements (212) in the first chamber (21). Thus, the temperature of heat transfer medium from the first chamber (11) is lower than that from the first chamber (21). Gradual heating of the heat transfer medium is therefore conducted in order to prevent faster degradation of the heat transfer medium from occurring.

Note also that since the second chambers (12, 22) are disposed above the first chambers (11, 21), the temperatures in the second chambers (12, 22) are lower than those in the first chambers (11, 21). The upright pipes (121, 221) are relatively thin and have enlarged upper ends so as to minimize the effect of the heat generated by the heating units on the temperature of the heat transfer medium inside the tanks (123, 223). Prolongation of the useful life of the heat transfer medium can therefore be enhanced since only a portion of the total volume of the heat transfer medium used is heated to relatively high temperatures. Furthermore, the heat transfer medium in the tanks (123, 223) prevents the exposure to air of portions of the heat transfer medium which are at a relatively high temperature [such as those in the first chambers (11, 21)]. This further prolongs the useful life of the heat transfer medium.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A heating device for a circulating heat transfer medium, comprising:

first and second heating stages, each of said first and second heating stages having a first chamber and a second chamber disposed above and communicated with the corresponding said first chamber, said first chamber having an inlet, an outlet and at least one electric heating unit provided therein; and a conduit having two ends respectively connected to said outlet of said first chamber of said first heating stage and to said inlet of said first chamber of said second heating stage; a second conduit communicating said second chambers of said first and second heating stages; whereby, heat transfer medium which enters said inlet of said first chamber of said first heating stage is heated by said electric heating unit inside said first chamber before flowing through said outlet and into said conduit; heat transfer medium which flows through said conduit enters said inlet of said first chamber of said second heating stage and is heated by said electric heating unit inside said first chamber before flowing through said outlet of said first chamber of said second heating stage.

2. A heating device for a circulating heat transfer medium, comprising:

first and second heating stages, each of said first and second heating stages having a first chamber and a second chamber disposed above and communicated with the corresponding said first chamber, said first chamber having an inlet, an outlet and at least one electric heating unit provided therein; and a conduit having two ends respectively connected to said outlet of said first chamber of said first heating stage and to said inlet of said first chamber of said second heating stage;

whereby, heat transfer medium which enters said inlet of said first chamber of said first heating stage is heated by said electric heating unit inside said first chamber before flowing through said outlet and into said conduit; heat transfer medium which flows through said conduit enters said inlet of said first chamber of said second heating stage and is heated by said electric heating unit inside said first chamber before flowing through said outlet of said first chamber of said second heating stage and an adjustment chamber disposed beneath said first chambers of said first and second heating stages; a pipe means communicating each of said first chambers and said adjustment chamber; and a control valve means provided on said pipe means to control the flow of heat transfer medium rom said first chambers to said adjustment chamber.

3. The heating device as claimed in claim 2, wherein said adjustment chamber has a lower end provided with a pipe unit and a control valve means to control the flow of heat transfer medium through said pipe unit, heat transfer medium flowing through said pipe unit being combined with heat transfer medium flowing through said outlet of said first chamber of said second heating stage.

4. The heating device as claimed in claim 2, further comprising:

a second conduit communicating said second chambers of said first and second heating stages; and an overflow tube having a first end connected to said second chamber of one of said first and second heating stages adjacent to a top end of said second chamber and a second end connected to said adjustment chamber.

* * * * *